US011804163B2

(12) United States Patent
Xiao

(10) Patent No.: US 11,804,163 B2
(45) Date of Patent: Oct. 31, 2023

(54) DISPLAY METHOD, DISPLAY DEVICE AND COMPUTER STORAGE MEDIUM

(71) Applicant: BOE TECHNOLOGY GROUP CO., LTD., Beijing (CN)

(72) Inventor: Xiangchun Xiao, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 20 days.

(21) Appl. No.: 17/608,948

(22) PCT Filed: May 7, 2020

(86) PCT No.: PCT/CN2020/088951
§ 371 (c)(1),
(2) Date: Nov. 4, 2021

(87) PCT Pub. No.: WO2020/228580
PCT Pub. Date: Nov. 19, 2020

(65) Prior Publication Data

US 2022/0319381 A1 Oct. 6, 2022

(30) Foreign Application Priority Data

May 10, 2019 (CN) ..... 201910389905.5

(51) Int. Cl.
*G09G 5/00* (2006.01)
*G09G 3/20* (2006.01)

(52) U.S. Cl.
CPC ... *G09G 3/2074* (2013.01); *G09G 2320/0673* (2013.01); *G09G 2360/144* (2013.01); *G09G 2360/16* (2013.01)

(58) Field of Classification Search
CPC ..... G09G 3/2074; G09G 2320/0673; G09G 2360/144; G09G 2360/16
USPC ..... 345/204
See application file for complete search history.

(56) References Cited

U.S. PATENT DOCUMENTS 10,212,429 B2 2/2019 Guo et al.
2006/0001624 A1* 1/2006 Lee ..... G09G 3/3233 345/82
2010/0027073 A1 2/2010 Lin et al.
2011/0074803 A1* 3/2011 Kerofsky ..... G09G 3/3406 345/589

(Continued)

FOREIGN PATENT DOCUMENTS

CN 1713254 A 12/2005
CN 101105912 A 1/2008

(Continued)

OTHER PUBLICATIONS

International search report of PCT application No. PCT/CN2020/088951 dated Jul. 29, 2020.

*Primary Examiner* — Jennifer T Nguyen
(74) *Attorney, Agent, or Firm* — Lippes Mathias LLP

(57) ABSTRACT

Provided is a display method which includes: acquiring luminance information of the environment where the display device is currently located, wherein the luminance information includes at least one of ambient luminance information and reflection luminance information; and based on the acquired luminance information, determining a target gamma curve of the display device. A display device and a non-transitory computer-readable computer storage medium are also provided.

10 Claims, 9 Drawing Sheets

(56) References Cited

U.S. PATENT DOCUMENTS

2014/0292792 A1* 10/2014 Chen ..... G09G 5/10
345/589

FOREIGN PATENT DOCUMENTS

| | | | |
|---|---|---|---|
| CN | 101191926 | A | 6/2008 |
| CN | 102113046 | A | 6/2011 |
| CN | 103021315 | A | 4/2013 |
| CN | 106030503 | A | 10/2016 |
| JP | 2015069021 | A | 4/2015 |

* cited by examiner

DISPLAY METHOD, DISPLAY DEVICE AND COMPUTER STORAGE MEDIUM

CROSS-REFERENCE TO RELATED APPLICATIONS

This application is a 371 of PCT Application No. PCT/CN2020/088951, filed on May 7, 2020, which claims the benefit of priority to Chinese Application No. 201910389905.5, filed on May 10, 2019, both of which are incorporated by reference herein.

TECHNICAL FIELD

The present disclosure relates to a display method, a display device, and a computer storage medium.

BACKGROUND

In the field of display technologies, luminance information of a display screen of a display device is presented based on a predetermined gamma curve (also called gamma function) in the display device. The gamma curve describes a nonlinear relationship between the grayscale and luminance of each sub-pixel. In the related art, in order to enable the display device to display pixels with a uniform standard luminance, a unified gamma curve is often predetermined in the display device.

SUMMARY

Embodiments of the present disclosure provide a display method, a display device, and a computer storage medium. The technical solutions are as follows.

In a first aspect, a display method is provided.

The display method includes: acquiring luminance information of a current environment of a display device, wherein the luminance information includes at least one of ambient luminance information and reflection luminance information; and determining a target gamma curve of the display device based on the acquired luminance information.

Optionally, when the acquired luminance information includes the ambient luminance information, determining the target gamma curve of the display device based on the acquired luminance information includes: determining a gamma parameter based on the ambient luminance information; and determining the target gamma curve based on the gamma parameter.

Optionally, determining the target gamma curve based on the gamma parameter includes: determining the target gamma curve according to a first curve equation and based on the gamma parameter, wherein the first curve equation includes: $L=L_{max}[n/N]^{\gamma}$; wherein L is a luminance value of a first sub-pixel, n is a grayscale value of the first sub-pixel, the first sub-pixel is one sub-pixel in an image to be displayed of the display device, $L_{max}$ is a maximum luminance reference value of the display device, $\gamma$ is the gamma parameter, and N is a maximum grayscale value of the display device.

Optionally, when the luminance information includes the ambient luminance information and the reflection luminance information, determining the target gamma curve of the display device based on the acquired luminance information includes: determining a gamma parameter based on the ambient luminance information; determining a grayscale correction parameter based on the reflection luminance information and the gamma parameter; and determining the target gamma curve based on the grayscale correction parameter and the gamma parameter.

Optionally, the reflection luminance information includes a luminance value of reflected light of a display surface of the display device, and determining the grayscale correction parameter based on the reflection luminance information and the gamma parameter includes: determining a greater value of a minimum luminance value of light emergent from the display surface of the display device and the luminance value of the reflected light as a minimum luminance reference value of the display device; and determining the grayscale correction parameter based on the minimum luminance reference value of the display device and the gamma parameter.

Optionally, determining the grayscale correction parameter based on the minimum luminance reference value of the display device and the gamma parameter includes: determining the grayscale correction parameter according to a first grayscale equation, wherein the first grayscale equation includes: $L_{min}=L_{max}[n_0/(N+n_0)]^{\gamma}$; wherein $L_{min}$ is the minimum luminance reference value of the display device, $L_{max}$ is the maximum luminance reference value of the display device, $n_0$ is the grayscale correction parameter, $\gamma$ is the gamma parameter, and N is the maximum grayscale value of the display device.

Optionally, determining the target gamma curve based on the grayscale correction parameter and the gamma parameter includes: determining the target gamma curve according to a second curve equation, wherein the second curve equation includes: $L=L_{max}[(n+n_0)/(N+n_0)]^{\gamma}$; wherein L is the luminance value of the first sub-pixel, n is the grayscale value of the first sub-pixel, the first sub-pixel is one sub-pixel in the image to be displayed of the display device, $L_{max}$ is the maximum luminance reference value of the display device, $\gamma$ is the gamma parameter, N is the maximum grayscale value of the display device, and $n_0$ is the grayscale correction parameter.

Optionally, the ambient luminance information includes a luminance value of ambient light, and the luminance value of the ambient light is negatively correlated with the gamma parameter.

Optionally, when the luminance value of the ambient light is in a first ambient luminance value range, the display device is in a first mode, when the luminance value of the ambient light is in a second ambient luminance value range, the display device is in a second mode, when the luminance value of the ambient light is in a third ambient luminance value range, the display device is in a third mode, and when the luminance value of the ambient light is in a fourth ambient luminance value range, the display device is in a fourth mode; wherein the first ambient luminance value range, the second ambient luminance value range, the third ambient luminance value range, and the fourth ambient luminance value range are different from one another.

Optionally, the first ambient luminance value range is from 0 to 20 nits, and the gamma parameter corresponding to the first mode is 2.4; the second ambient luminance value range is from 21 to 150 nits, and the gamma parameter corresponding to the second mode is 2.2; the third ambient luminance value range is from 151 to 300 nits, and the gamma parameter corresponding to the third mode is 2.0; and the fourth ambient luminance value range is greater than 300 nits, and the gamma parameter corresponding to the fourth mode is 1.8.

Optionally, when the acquired luminance information includes the reflection luminance information, determining the target gamma curve of the display device based on the acquired luminance information includes: determining a grayscale correction parameter based on the reflection luminance information; and determining the target gamma curve based on the grayscale correction parameter.

Optionally, the reflection luminance information includes a luminance value of reflected light of a display surface of the display device, and determining the grayscale correction parameter based on the reflection luminance information includes: determining a greater value of a minimum luminance value of the light emergent from the display surface of the display device and the luminance value of the reflected light as a minimum luminance reference value of the display device; and determining the grayscale correction parameter based on the minimum luminance reference value of the display device.

Optionally, determining the grayscale correction parameter based on the minimum luminance reference value of the display device includes: determining the grayscale correction parameter based on a second grayscale equation, and the second grayscale equation includes: $L_{min}=L_{max}[n_0/(N+n_0)]^{\gamma_1}$; wherein $L_{min}$ is the minimum luminance reference value of the display device, $L_{max}$ is the maximum luminance reference value of the display device, $n_0$ is the grayscale correction parameter, $\gamma_1$ is a reference gamma parameter, and N is the maximum grayscale value of the display device.

Optionally, determining the target gamma curve based on the grayscale correction parameter includes: determining the target gamma curve according to a third curve equation, wherein the third curve equation includes: $L=L_{max}[(n+n_0)/(N+n_0)]^{\gamma_1}$; wherein L is the luminance value of the first sub-pixel, n is the grayscale value of the first sub-pixel, the first sub-pixel is one sub-pixel in the image to be displayed of the display device, $L_{max}$ is the maximum luminance reference value of the display device, $\gamma_1$ is the reference gamma parameter, N is the maximum grayscale value of the display device, and the $n_0$ is the grayscale correction parameter.

Optionally, the display device includes a processor and a display driving circuit, the method is applicable to the processor, and a predetermined gamma curve is set in the display driving circuit, and after determining the target gamma curve of the display device based on the acquired luminance information, the method includes: acquiring a grayscale value of a first sub-pixel, wherein the first sub-pixel is one sub-pixel in an image to be displayed of the display device; converting the grayscale value of the first sub-pixel into a target grayscale value of the first sub-pixel based on the target gamma curve and the predetermined gamma curve; and inputting the target grayscale value of the first sub-pixel to the display driving circuit.

Optionally, parameters of the target gamma curve and parameters of the predetermined gamma curve both include luminance value, and converting the grayscale value of the first sub-pixel into a target grayscale value of the first sub-pixel based on the target gamma curve and the predetermined gamma curve includes: acquiring a corresponding relationship between the grayscale value of the first sub-pixel and the target grayscale value of the first sub-pixel when the luminance value of the target gamma curve is equal to the luminance value of the predetermined gamma curve; and determining the target grayscale value of the first sub-pixel based on the corresponding relationship.

In another aspect, a display device for performing the above method is provided. The display device includes: a light sensor, configured to acquire luminance information of a current environment of the display device; and an adjusting module, configured to determine a target gamma curve based on the luminance information.

Optionally, the display device includes a display driving circuit, and the display driving circuit including the adjusting module; or the display device includes a processor, the processor including the adjusting module.

In another aspect, a display device is provided. The display device includes a processor and a memory storing at least one instruction, at least one program, a code set, or an instruction set; wherein the at least one instruction, the at least one program, the code set, or the instruction set, when loaded and executed by the processor, causes the processor to perform the above display method.

In another aspect, a computer storage medium is provided. The computer storage medium stores at least one instruction, at least one program, a code set, or an instruction set; wherein the at least one instruction, the at least one program, the code set, or the instruction set, when loaded and executed by a processor, causes the processor to perform the above display method.

BRIEF DESCRIPTION OF THE DRAWINGS

For clearer descriptions of the technical solutions in the embodiments of the present disclosure, the following briefly introduces the accompanying drawings required for describing the embodiments. Apparently, the accompanying drawings in the following description show merely some embodiments of the present disclosure, and persons of ordinary skill in the art may still derive other drawings from these accompanying drawings without creative efforts.

DETAILED DESCRIPTION

Figure 1:
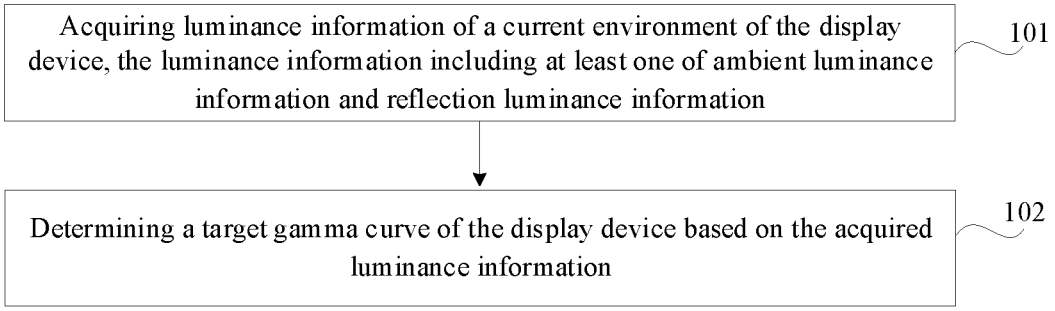
FIG. 1 is a flowchart of a display method according to an embodiment of the present disclosure.

The embodiments of the present disclosure are described in conjunction with the accompanying drawings.

If a scene is expected to be presented on a display device as an image, two steps are required usually. One step includes converting, by an image acquisition device, the optical information in the scene into the image information through a nonlinear mapping relationship and storing the image information. This process is essentially a process of converting an optical signal into a digital signal and storing the digital signal. The other step includes converting, by the display device, the image information into the optical information presented by the display device based on the nonlinear mapping relationship. This process is essentially a process of converting the digital signal into the optical signal and presenting the optical signal. The first process of converting the optical signal into the digital signal is also referred to as a photoelectric conversion process. The nonlinear mapping relationship used in the process is referred to as a photoelectric conversion function. Correspondingly, the second process of converting the digital signal into the optical signal is also referred to as an electro-optical conversion process, and the nonlinear mapping relationship used in the process is referred to as an electro-optical conversion function.

Display modes described in the embodiments of the present disclosure involve the abovementioned electro-optical conversion process, and the adopted function is the electro-optical conversion function (also called "gamma curve" or "gamma function," which is described as "gamma curve" hereinafter).

The abovementioned scene may be a real scene existing in nature, and correspondingly, the image acquisition device is a physical camera device. The abovementioned scene may also be a virtual scene constructed by humans, and correspondingly, the image acquisition device is a virtual camera device.

It shall be understood that, although the terms "first," "second," "third," and the like may be used herein to describe various information, the information should not be limited by these terms. These terms are only used to distinguish one category of information from another. For example, without departing from the scope of the present disclosure, first information may be referred as second information; and similarly, second information may also be referred as first information. As used herein, the term "if" may be interpreted as "when" or "upon" or "in response to determining" depending on the context.

In the field of display technologies, luminance information of a display screen of the display device is presented by the gamma curve predetermined in the display device, and the gamma curve describes a nonlinear relationship between the grayscale value (i.e., the digital signal) of each sub-pixel in an image to be displayed and the luminance value (i.e., the optical signal) of the corresponding sub-pixel in the display screen. In order to correctly present the image information captured by the image acquisition device in the display device, a series of industry standards have been formulated for the gamma curve in the industry, and the industry standards are usually called the gamma standard. The gamma standard consists of several function equations, for example, the photoelectric conversion function and the electro-optical conversion function mentioned above. By taking the electro-optical conversion function involved in the gamma standard as an example, the industry standard can determine that different digital signals should correspond to different optical signals when the digital signals are converted into the optical signals. That is, different grayscale values should correspond to different luminance values. The selection of materials and design principles are different for different display devices, but after the gamma standard is adopted, the digital signals may be converted into the optical signals according to a unified standard, such that all display devices can display the pixels with a uniform standard luminance.

However, inventors of the present disclosure found that if the pixels are displayed with the uniform gamma standard, the influence of an ambient luminance on the screen luminance is obviously ignored, and the influence is mainly embodied in a visual effect when human eyes view the display screen.

Under different ambient luminance, pupils of the human eyes will change to varying degrees. When the human eyes are in a dark environment, the pupils will consciously dilate, such that the amount of light incident to the pupils is increased, and further the human eyes have strong perception for luminance information corresponding to low grayscale values. Therefore, the human eyes are more sensitive to a luminance difference between low grayscales, that is, the human eyes can clearly distinguish details of a dark image. On the contrary, when the human eyes are in a bright environment, the pupils consciously shrink, such that the amount of light incident to the pupils is reduced, and further the human eyes have poor perception for the luminance information corresponding to the low grayscale values. In this case, the difference value between the luminance information corresponding to two adjacent grayscale values in a low grayscale area is less than a luminance difference threshold that can be perceived by the human eyes. As a result, the human eyes are unable to distinguish the details of the dark image.

That is to say, in the brighter environment, the ambient luminance exerts a greater impact on the screen luminance, resulting in a poor display effect of the display device.

Based on this, an embodiment of the present disclosure provides a display method applicable to a display device. The display method involves the electro-optical conversion function in the gamma standard, and can adjust the gamma curve of the display device according to different environments where the display device is currently located. As shown in FIG. 1, the method may include the following steps.

In step 101, the luminance information of a current environment of the display device is acquired. The luminance information includes at least one of ambient luminance information and reflection luminance information.

In step 102, a target gamma curve of the display device is determined based on the acquired luminance information.

In summary, in the display method according to the embodiment of the present disclosure, the gamma curve can be determined based on the luminance information of the current environment of the display device, such that a display effect of the display device can be flexibly adapted to changes of the environment of the display device, thereby avoiding the problem of poor effect of the display device in the related art and effectively enhancing the display effect of the display device.

In this way, no matter if the display device is in a brighter environment or a darker environment, when users view the display screen presented by the display device, the display screen can present the same display effect to the users, which allows the users to acquire the same grayscale experience. That is, in different bright and dark environments, the users can perceive a similar visual effect for the same grayscale value. Thus, a resolution of the display screen is ensured, and it is also ensured that the number of grayscale values that can be perceived by the human eyes in the display screen are not decreased, thereby ensuring the display effect of the display device and the visual effect for the user.

Step 102 may include the following three cases. In the first case, the target gamma curve is determined based on the ambient luminance information. In the second case, the target gamma curve is determined based on the reflection luminance information. In the third case, the target gamma curve is determined based on the ambient luminance information and the reflection luminance information. Three display methods are provided below for the three cases.

Figure 2:
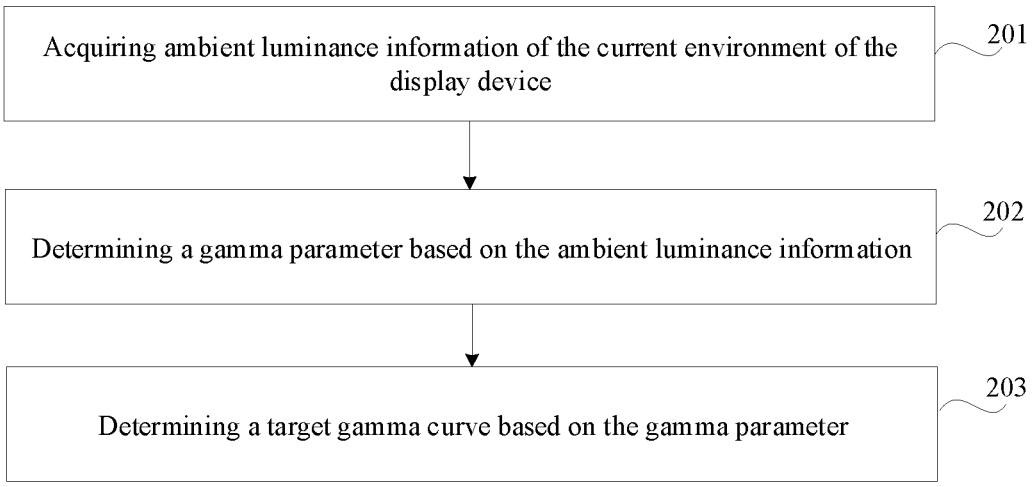
FIG. 2 is a flowchart of another display method according to an embodiment of the present disclosure.

In a display method, the luminance information includes ambient luminance information, and the ambient luminance information may include a luminance value of ambient light in the environment of the display device. As shown in FIG. 2, the method includes the following steps.

In step 201, the ambient luminance information of the current environment of the display device is acquired.

When the embodiment of the present disclosure is applied, a sensor capable of collecting the luminance information may be disposed in the display device (or where the display device is located) to acquire the ambient luminance information of the current environment of the display device. That is, the sensor may be disposed inside the display device, or disposed outside the display device and is connected to the display device in a wired or wireless fashion. For example, the sensor may be a light sensor or the like.

In step 202, a gamma parameter is determined based on the ambient luminance information.

Figure 3:
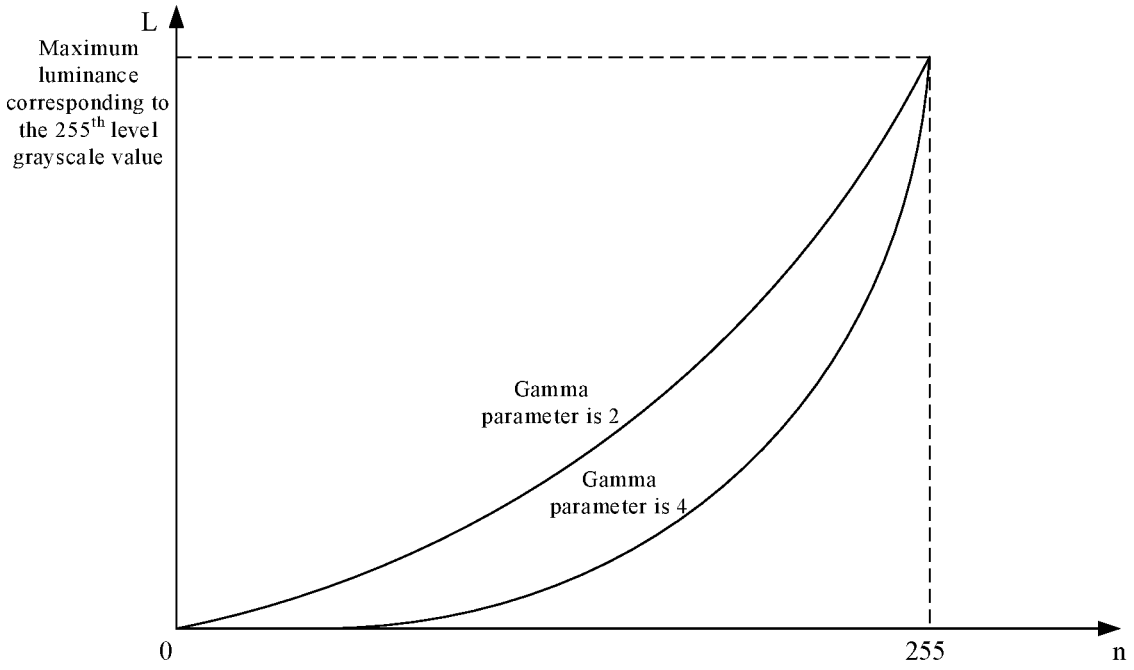
FIG. 3 is a schematic diagram of two gamma curves in the related art.

The gamma parameter may adjust the gamma curve. The gamma curve is usually an exponential function. FIG. 3 schematically shows different gamma curves corresponding to two different gamma parameters, that is, the corresponding gamma curve when the gamma parameter is 2, and the corresponding gamma curve when the gamma parameter is 4.

Optionally, the luminance information is the luminance value of the ambient light, and the luminance value of the ambient light is negatively correlated with the gamma parameter. The reason for such a setting is that under normal circumstances, the greater the value of the gamma parameter is, the greater the degree of nonlinearity of the gamma curve is (that is, the greater the degree of curvature of an arc is). However, for the characteristics of the human eyes, the greater the ambient luminance is, the weaker the perception of the human eyes for a light contrast is, that is, the worse the perception of the human eyes for the luminance information corresponding to low grayscale values is.

Referring to FIG. 3, for the gamma curve with a greater degree of nonlinearity (that is, the gamma curve corresponding to the gamma parameter 4), the change of the luminance value L is not obvious in an area with smaller grayscale values. At this point, a darker environment may be combined. Since the human eyes are more sensitive to the luminance difference between the grayscales in a darker environment, the change of the luminance value in the area with smaller grayscale values can be accurately distinguished. As the ambient luminance increases, the pupils of the human eyes become smaller, and the sensitivity of the human eyes to the luminance difference between the grayscales also becomes weaker. However, if the value of the gamma parameter in the gamma curve decreases, the luminance difference in the low grayscale interval will increase, which can compensate to some extent for the influence of the smaller pupils on the low grayscales. On the contrary, for the gamma curve with a smaller degree of nonlinearity (that is, the gamma curve corresponding to the gamma parameter 2), the change of the luminance value is more obvious in the area with smaller grayscale values. At this point, the brighter environment can be combined, such that the human eyes can also accurately distinguish the change of the luminance value in the area with smaller grayscale values.

On such a basis, in the display method described in the embodiment of the present disclosure, a first ambient luminance value range and a second ambient luminance value range may be stored in the display device. The first ambient luminance value range and the second ambient luminance value range are different. The first ambient luminance value range corresponds to a first mode of the display device, and the second ambient luminance value range corresponds to a second mode of the display device. Different modes of the display device may correspond to different gamma parameters.

Optionally, the display device may also store a third ambient luminance value range and a fourth ambient luminance value range therein. The third ambient luminance value range, the fourth ambient luminance value range, the first ambient luminance value range and the second ambient luminance value range are different from one another. The third ambient luminance value range corresponds to a third mode of the display device, and the fourth ambient luminance value range corresponds to a fourth mode of the display device. The following are examples of four ambient luminance values and the gamma parameters corresponding to the four modes respectively.

1) The first ambient luminance value range is from 0 to 20 nits. When the luminance value of the ambient light is within this range, the display device is in a first mode.

Optionally, when the value range of the ambient luminance value is from 0 to 20 nits, the environment may be a theater environment, and correspondingly, the first mode may be a theater mode. The gamma parameter corresponding to the first mode may be 2.4.

2) The second ambient luminance value range is from 21 to 150 nits. When the luminance value of the ambient light is within this range, the display device is in a second mode.

Optionally, when the value range of the ambient luminance value is from 21 to 150 nits, the environment may be a living room environment, and correspondingly, the second mode may be a living room mode. The environment may also be an office environment, and correspondingly, the second mode may also be an office mode. The gamma parameter corresponding to the second mode may be 2.2.

3) The third ambient luminance value range is from 151 to 300 nits. When the luminance value of the ambient light is within this range, the display device is in a third mode.

Optionally, when the value range of the ambient luminance value is from 151 to 300 nits, the environment may be an exhibition hall environment, and correspondingly, the third mode may be an exhibition hall mode. The gamma parameter corresponding to the third mode may be 2.0.

4) The fourth ambient luminance value range is greater than 300 nits. When the luminance value of the ambient light is within this range, the display device is in a fourth mode.

Optionally, when the value range of the ambient luminance value is greater than 300 nits, the environment may be an outdoor environment, and correspondingly, the fourth mode may be an outdoor mode. The gamma parameter corresponding to the fourth mode may be 1.8.

When the embodiment of the present disclosure is applied, the value range of the luminance value may be divided in more detail. Accordingly, more modes may be set for the display device. The above four corresponding relationships are only illustrative.

When the embodiment of the present disclosure is applied, the display device may automatically judge the ambient luminance value acquired by the sensor, and determine which corresponding relationship the ambient luminance value belongs to, such that the display device is automatically adjusted to the corresponding mode in the corresponding relationship. The mode of the display device may also be manually adjusted by the user, which is not limited in the embodiment of the present disclosure.

In step 203, the target gamma curve is determined based on the gamma parameter.

After the corresponding gamma parameter is determined based on the luminance information of the current environment of the display device, the target gamma curve may be determined based on the gamma parameter.

Since the nonlinear relationship between the grayscale value and the luminance value in the display device is determined by physical characteristics of the display device, a gamma curve is predetermined in each display device, and the gamma curve predetermined in different display devices may be different. In step 203, based on the predetermined gamma curve, the predetermined gamma curve may be adjusted based on the gamma parameter to acquire the target gamma curve. In another fashion, the target gamma curve may also be determined based on the gamma parameter and a specified gamma curve (the specified gamma curve may be the same in different display devices). Therefore, in step 203, two fashions are available for determining the target gamma curve based on the gamma parameter.

In the first method for determining the target gamma curve, the predetermined gamma curve is adjusted based on the gamma parameter to acquire the determined target gamma curve. In this method, step 203 includes the following steps.

In step 203*a*, the predetermined gamma curve in the display device is acquired.

In order to adjust the gamma curve to acquire the target gamma curve, the predetermined gamma curve in the display device may be acquired. The predetermined gamma curve may be expressed as a function about the gamma value and grayscale value.

In step 203*b*, the predetermined gamma curve is adjusted based on the gamma parameter to acquire the target gamma curve.

The fashion of adjusting the predetermined gamma curve may be to replace the gamma value in the predetermined gamma curve with the gamma parameter, and the replaced gamma curve is the target gamma curve.

The sub-pixels in an image to be displayed correspond to the sub-pixels in the display screen of the display device one to one. In the first method for determining the target gamma curve, by using the grayscale value of the first sub-pixel in the image to be displayed and the gamma parameter and the predetermined gamma curve, the luminance value of the sub-pixel corresponding to a target sub-pixel in the display screen may be determined, such that the display screen can enable the image to be displayed to reappear on a display screen. In the related art, no matter what environment the display device is deployed in, the value of the gamma parameter $\gamma$ is a fixed value. For example, the commonly used gamma parameter is 2.2. However, in the embodiment according to the present disclosure, multiple gamma parameters may be set based on the luminance value of the environment of the display device. $L=L_{max}[n/N]^{\gamma}$ is taken as an example of the predetermined gamma curve equation of a certain display device, wherein L is the luminance value of a first sub-pixel, n is the grayscale value of the first sub-pixel, the first sub-pixel is any sub-pixel in the image to be displayed, $L_{max}$ is a maximum luminance reference value of the display device, $\gamma$ is the gamma parameter (the gamma parameter is an exponent in the gamma curve equation), and N is a maximum grayscale value of the display device.

When the luminance value of the ambient light of the display device is in the range of 0 to 20 nits, it is determined that the luminance value is a first ambient luminance value, the display device is in the first mode, the gamma parameter corresponding to the first mode is 2.4, and then the gamma curve may be expressed as $L=L_{max}(n/N)^{2.4}$.

When the luminance value of the ambient light of the display device is in the range of 21 to 150 nits, it is determined that the luminance value is a second ambient luminance value, the display device is in the second mode, the gamma parameter corresponding to the second mode is 2.2, and then the gamma curve may be expressed as $L=L_{max}(n/N)^{2.2}$.

When the luminance value of the ambient light of the display device is in the range of 151 to 300 nits, it is determined that the luminance value is a third ambient luminance value, the display device is in a third mode, the gamma parameter corresponding to the third mode is 2.0, and then the gamma curve may be expressed as $L=L_{max}(n/N)^{2.8}$.

When the luminance value of the ambient light of the display device is in the range greater than 300 nits, it is determined that the luminance value is a fourth ambient luminance value, the display device is in the fourth mode, the gamma parameter corresponding to the fourth mode is 1.8, and then the gamma curve may be expressed as $L=L_{max}(n/N)^{1.8}$.

It should be noted that the maximum grayscale value N of the display device is related to the capacity of a memory in the display device. For example, for the memory capable of storing 8 bits, $2^8$ grayscales can be presented, that is, 256 grayscales, then the grayscale value range is from 0 to 255, and the maximum grayscale value of the display device is 255. For another example, for the memory capable of storing 6 bits, $2^6$ grayscales can be presented, that is, 64 grayscales, then the grayscale value range is from 0 to 63, and the maximum grayscale value of the display device is 63.

In the second method for determining the target gamma curve, the target gamma curve is re-determined based on the gamma parameter and the specified gamma curve.

In this fashion, there is no need to reacquire the predetermined gamma curve in the display device, and the target gamma curve is re-determined based on the gamma parameter and the specified gamma curve. The specified gamma curve may be expressed as a first curve equation. The first curve equation includes: $L=L_{max}[n/N]^{\gamma}$, wherein L is the luminance value of the first sub-pixel, n is the grayscale value of the first sub-pixel, the first sub-pixel is one sub-pixel in the image to be displayed in the display device, $L_{max}$ is the maximum luminance reference value of the display device, $\gamma$ is the gamma parameter (the gamma parameter is an exponent in the first curve equation), and N is the maximum grayscale value of the display device. The gamma parameter is substituted into the first curve equation to acquire the target gamma curve. Multiple gamma parameters may be set based on the luminance value of the environment of the display device, and for details about this process, reference may be made to the related description in the first method for determining the target gamma curve.

Figure 4:
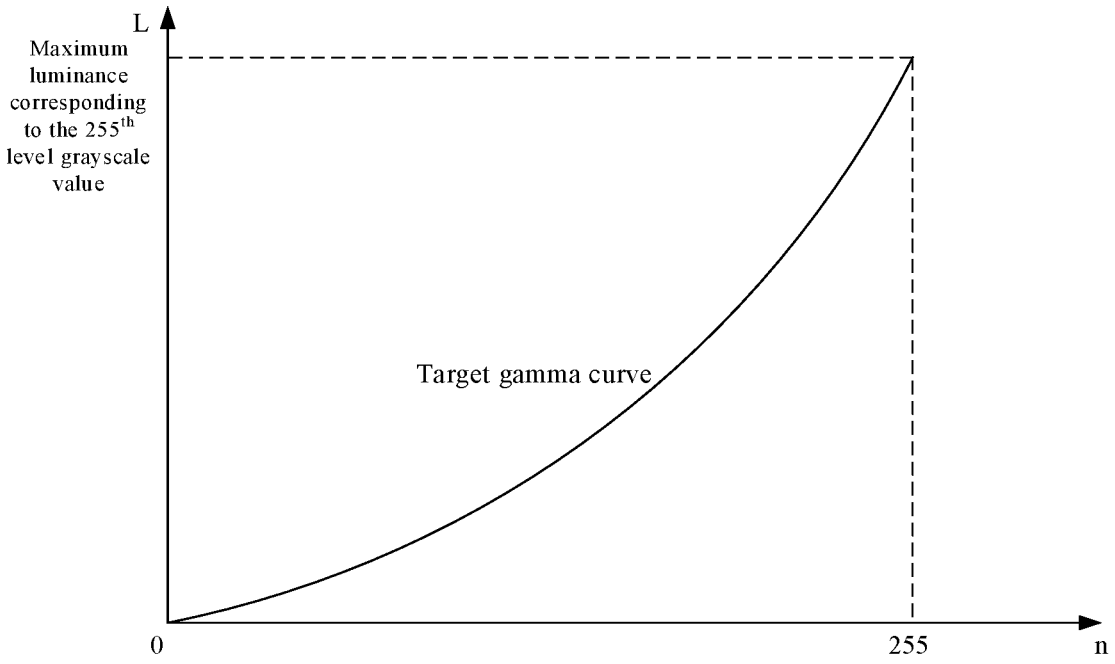
FIG. 4 is a schematic diagram of a target gamma curve according to an embodiment of the present disclosure.

FIG. 4 schematically shows a schematic diagram of a target gamma curve. The target gamma curve is represented by the first curve equation. In a coordinate axis of the gamma curve, a horizontal axis is the grayscale value, and a vertical axis is the luminance value. In the target gamma curve shown in FIG. 4, the maximum grayscale value N of the display device is 255.

It should be noted that in the first curve equation, the maximum luminance value $L_{max}$ of the sub-pixel represents the luminance value of the first sub-pixel. In other optional embodiments, a minimum luminance value $L_{min}$ of the sub-pixel may also represent the luminance value of the first sub-pixel.

The process of re-determining the target gamma curve is actually a process of re-determining a corresponding relationship between the luminance value of the first sub-pixel and the grayscale value of the first sub-pixel. For details about the determined corresponding relationship, reference may be made to the first curve equation, which are not further described in the embodiment of the present disclosure. The luminance value of the sub-pixel corresponding to the target sub-pixel in the display screen may be determined through the grayscale value of the first sub-pixel in the image to be displayed, the gamma parameter, and the re-determined gamma curve, such that the display screen can enable the image to be displayed to reappear on the display screen, the image to be displayed can be adapted to different environments and better visual experience is provided to the users.

In summary, in the display method according to the embodiment of the present disclosure, the gamma curve can be determined based on the ambient luminance information of the current environment of the display device, such that the display effect of the display device can be flexibly adapted to the changes of the environment of the display device. The technical effect of dynamically determining the gamma curve is realized based on the ambient luminance information, the problem of poor effect of the display device in the related art is avoided, and the display effect of the display device is effectively improved.

In the above display method, the luminance values of the display device from $0^{th}$ level to $N^{th}$ level grayscale values are determined. Regardless of the original gamma curve or the target gamma curve of the display device, a spatial range of the grayscale values is also from the $0^{th}$ level to the $N^{th}$ level, and the spatial range of the luminance values is also from the luminance corresponding to the $0^{th}$ level grayscale value to the luminance corresponding to the $N^{th}$ level grayscale value. During the production preparation of the display device, the luminance values of the display device under the conditions of the $0^{th}$ level to the $N^{th}$ level are taken as standard luminance values.

However, the inventors of the present disclosure also found that in many actual cases, the luminance value corresponding to the minimum grayscale value of the display device is not 0, and the luminance corresponding to the maximum grayscale value of the display device is not the luminance value defined by the $N^{th}$ level grayscale value. In other words, the spatial range of the luminance values of the display device in an actual use process is not the above-mentioned standard luminance values. Therefore, the spatial range of the grayscale value and the spatial range of the luminance value of the target gamma curve may be adjusted correspondingly to present more luminance information under low grayscales.

Figure 5:
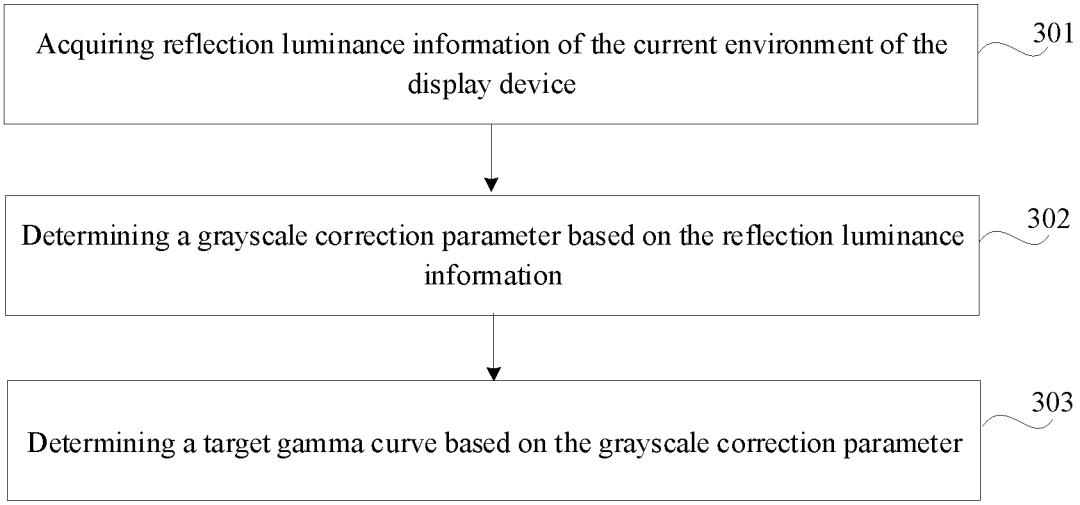
FIG. 5 is a flowchart of yet another display method according to an embodiment of the present disclosure.

Based on this, in another display method, the luminance information includes reflection luminance information. The method is also applied to a display device. As shown in FIG. 5, the method includes the following steps.

In step 301, the reflection luminance information of the current environment of the display device is acquired.

The reflection luminance information includes a luminance value of reflected light formed by reflecting the ambient light through a display surface of the display device. The luminance value of the reflected light is related to the ambient light of the current environment of the display device. Optionally, the luminance value of the reflected light may be determined based on the product of a reflectance of the display surface of the display device and the luminance value of the ambient light, wherein for details about the method for acquiring the luminance value of the ambient light, reference may be made to step 201.

For example, when a display device is deployed in an outdoor cloudy environment, the luminance value of the reflected light of the display surface is less than the luminance value of the reflected light of the display surface when the display device is deployed in an outdoor sunny environment. When the display device is deployed in an outdoor sunny environment, the luminance value of the reflected light of the display surface is less than the luminance value of the reflected light of the display surface when the display device is deployed in an outdoor sunny noon environment.

Since the ambient light reflected by the display surface also affects the display effect of the display device, in step 301, in the current environment of the display device, the luminance value of the reflected light formed by reflecting the ambient light through the display surface of the display device may be acquired.

In step 302, a grayscale correction parameter is determined based on the reflection luminance information.

Figure 6:
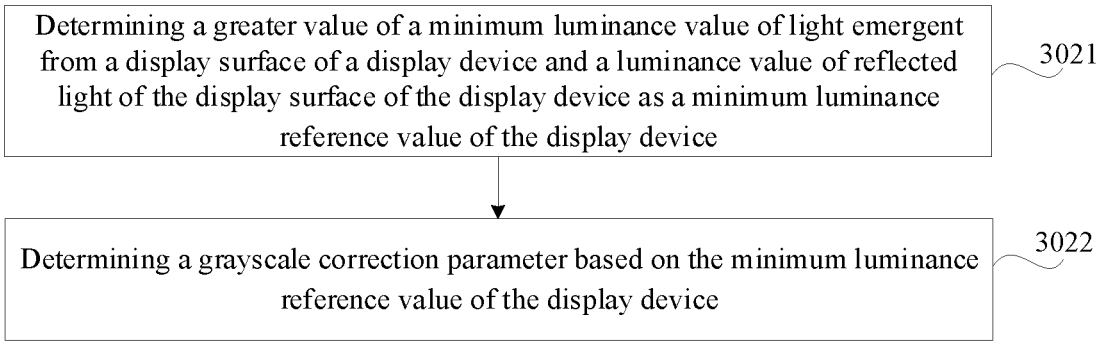
FIG. 6 is a flowchart of determining a grayscale correction parameter according to an embodiment of the present disclosure.

Optionally, as shown in FIG. 6, step 302 may include the following steps.

In step 3021, a greater value of the minimum luminance value of the light emergent from the display surface of the display device and the luminance value of the reflected light of the display surface of the display device is determined as a minimum luminance reference value of the display device.

In the spatial area of the luminance value that can be actually presented by the display device, the minimum luminance reference value of the display device may depend on two aspects. One aspect is the luminance value of the reflected light of the display surface of the display device (the reflected light is formed by reflecting external ambient light irradiating the display surface). The second aspect is the minimum luminance value of the light emergent from the display surface of the display device. The greater luminance value can affect a visual perception of the human eyes. Therefore, the greater value can be determined as the minimum luminance reference value of the display device. The minimum luminance reference value of the display device may be called an actual minimum luminance value of the display device for the visual perception of the human eyes.

As mentioned above, the luminance value of the reflected light of the display surface of the display device may be determined based on the product of the reflectance of the display surface of the display device and the luminance value of the ambient light. The minimum luminance value of the light emergent from the display surface of the display device may be determined according to physical characteristics of the display device.

It should be noted that when the luminance value of the current environment of the display device is greater than a predetermined luminance threshold, the luminance value of the reflected light may be determined as the minimum luminance reference value of the display device, since at this point, the luminance value of the reflected light is obviously greater than the minimum luminance value of the light emergent from the display surface.

In step 3022, the grayscale correction parameter is determined based on the minimum luminance reference value of the display device.

When the embodiment of the present disclosure is applied, the actual minimum gray value of the display device may be determined based on the minimum luminance reference value of the display device and the maximum luminance reference value of the display device.

Optionally, the grayscale correction parameter is determined according to a second grayscale equation, and the second grayscale equation is: $L_{min}=L_{max}[n_0/(N+n_0)]^{\gamma 1}$.

In the above equation, $L_{min}$ is the minimum luminance reference value of the display device, $L_{max}$ is the actual maximum luminance reference value of the display device, $n_0$ is the grayscale correction parameter, and $\gamma_1$ is the reference gamma parameter. The reference gamma parameter may be a fixed value with a value range of [2.1, 2.3]. For example, the reference gamma parameter is 2.2, and N is the maximum grayscale value of the display device.

It should be noted that in actual application of the embodiment of the present disclosure, the maximum luminance reference value $L_{max}$ of the display device may not be the maximum luminance value in the standard luminance values. For example, for an 8-bit memory, $L_{max}$ may not be the luminance value corresponding to the $255^{th}$ level grayscale value. Similar to the minimum luminance reference value of the display device, the maximum luminance reference value of the display device is affected by two aspects. One aspect is the luminance value of the reflected light formed by reflecting the ambient light through the display surface of the display device, and the other aspect is the maximum luminance value of the light emergent from the display surface of the display device. For details about the luminance value of the reflected light, reference may be made to the above description, and the maximum luminance value of the light emergent from the display surface may also be determined according to the physical characteristics of the display device.

However, considering that the maximum luminance value of the display device is usually much greater than the luminance value of the reflected light formed by reflecting the ambient light through the display surface of the display device, the influence of the luminance value of the reflected light on the maximum luminance value of the display device can be ignored. Then, the maximum luminance reference value of the display device is determined by the maximum luminance value of the light emergent from the display surface of the display device. For example, for a liquid crystal display device in a standard dynamic range (SDR) with a maximum grayscale value of 255, the maximum luminance reference value of the liquid crystal display device is 250 nits.

In step 303, the target gamma curve is determined based on the grayscale correction parameter.

Optionally, the target gamma curve is determined according to a third curve equation (the third curve equation may be an expression of the target gamma curve), and the third curve equation includes:

$L=L_{max}[(n+n_0)/(N+n_0)]^{\gamma 1}$, wherein L is the luminance value of the first sub-pixel, n is the grayscale value of the first sub-pixel, the first sub-pixel is one sub-pixel in the image to be displayed of the display device, $L_{max}$ is the maximum luminance reference value of the display device, $\gamma_1$ is a reference gamma parameter ($\gamma_1$ is an exponent in the third curve equation), N is the maximum grayscale value of the display device, and no is the grayscale correction parameter.

Figure 7:
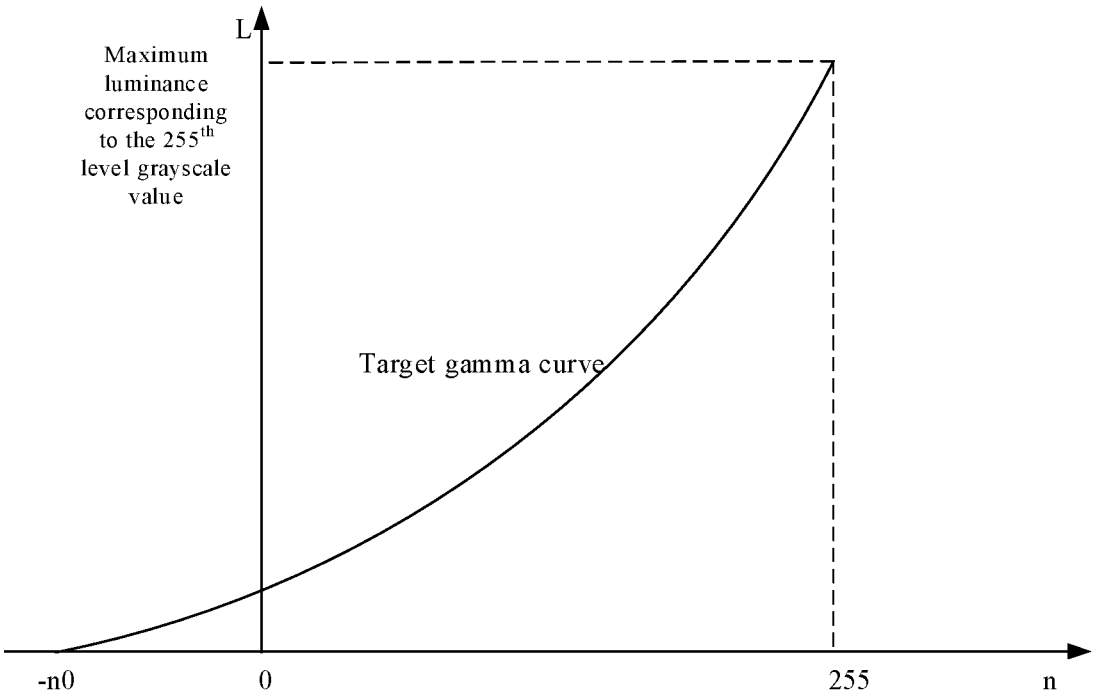
FIG. 7 is a schematic diagram of another target gamma curve according to an embodiment of the present disclosure.

FIG. 7 schematically shows a schematic diagram of another target gamma curve. The target gamma curve is generated according to the third curve equation. The vertical axis in FIG. 7 is shifted rightwards by a distance $|n_0|$ compared to the vertical axis in FIG. 4. Compared with the target gamma curve shown in FIG. 4, in the target gamma curve in FIG. 7, an interval space of grayscale values becomes smaller. However, the number of grayscales remains unchanged, such that more luminance values corresponding to the grayscale values can be presented, the display screen can show more luminance details, and the display effect of the display screen is enriched.

It should be noted that, similar to step 203, in step 303, based on the predetermined gamma curve, the predetermined gamma curve may be adjusted based on the grayscale correction parameter to acquire the target gamma curve. Optionally, in step 304, the target gamma curve may also be re-determined based on the grayscale correction parameter. For details about the related process of determining the target gamma curve, reference may be made to step 203, which are not further described in the embodiment of the present disclosure.

In summary, in the display method according to the embodiment of the present disclosure, the gamma curve is determined based on the grayscale correction parameter. The grayscale correction parameter is related to the reflection luminance information, such that according to the actual use environment, the lowest luminance actually displayed by the display device can be determined by the display effect of the display device. Therefore, the determined gamma curve can more accurately present the luminance information of the display screen, the problem of poor effect of the display device in the related art is reduced, and the display effect of the display device is effectively improved.

Figure 8:
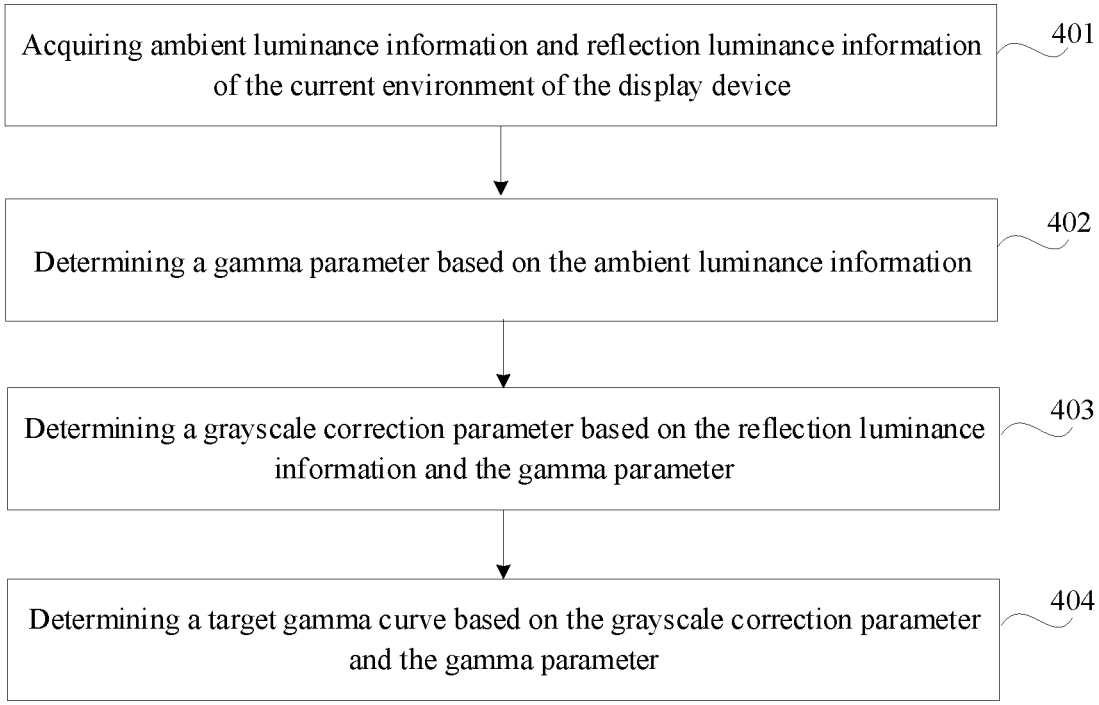
FIG. 8 is a flowchart of a further display method according to an embodiment of the present disclosure.

In addition, the embodiment of the present disclosure also provides another display method. In the display method, the luminance information includes ambient luminance and reflection luminance information. As shown in FIG. 8, the method includes the following steps.

In step 401, ambient luminance information and reflection luminance information of the current environment of the display device are acquired.

For details about the related steps of acquiring the ambient luminance information and the reflection luminance information of the current environment of the display device in step 401, reference may be made to the related steps in step 201 and step 301, which are not further described in the embodiment of the present disclosure.

In step 402, a gamma parameter is determined based on the ambient luminance information.

For details about the related process of determining the gamma parameter in step 402, reference may be made to step 302, which are not further described in the embodiment of the present disclosure.

In step 403, a grayscale correction parameter is determined based on the reflection luminance information and the gamma parameter.

Figure 9:
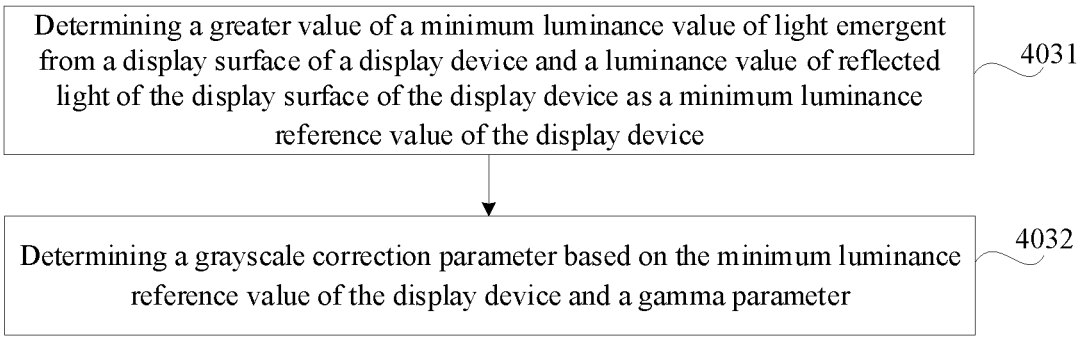
FIG. 9 is another flowchart of determining a grayscale correction parameter according to an embodiment of the present disclosure.

As shown in FIG. 9, step 403 may include the following steps.

In step 4031, a greater value of a minimum luminance value of light emergent from a display surface of the display device and a luminance value of the reflected light of the display surface of the display device is determined as a minimum luminance reference value of the display device.

For details about the related process in step 4031, reference may be made to the related process in step 3031, which are not further described in the embodiment of the present disclosure.

In step 4032, the grayscale correction parameter is determined based on the minimum luminance reference value of the display device and the gamma parameter.

Optionally, step 4032 includes: determining the grayscale correction parameter according to a first grayscale equation, and the first grayscale equation includes: $L_{min}=L_{max}[n_0/(N+n_0)]^{\gamma}$. The following may be acquired according to the first grayscale equation: $n_0=N/[(L_{max}/L_{min})^{(1/\gamma)}-1]$.

In the above equation, $L_{min}$ is the minimum luminance reference value of the display device, $L_{max}$ is the maximum luminance reference value of the display device, $n_0$ is the grayscale correction parameter, $\gamma$ is a gamma parameter, the gamma parameter may be determined according to step 402, and N is the maximum grayscale value of the display device.

In step 404, the target gamma curve is determined based on the grayscale correction parameter and the gamma parameter.

Optionally, step 404 may include: determining a target gamma curve according to a second curve equation (the second curve equation may be an expression of the target gamma curve), and the second curve equation includes: $L=L_{max}[(n+n_0)/(N+n_0)]^{\gamma}$.

In the above equation, L is the luminance value of the first sub-pixel, n is the grayscale value of the first sub-pixel, the first sub-pixel is one sub-pixel in the image to be displayed of the display device, and for related description of $L_{max}$, $\gamma$, N and $n_0$, reference may be made to step 4032.

In summary, in the display method according to the embodiment of the present disclosure, the gamma curve is determined based on the grayscale correction parameter and the gamma parameter determined based on the ambient luminance information together. The grayscale correction parameter is related to the reflection luminance information and the gamma parameter, such that not only is the display effect of the display device flexibly adapted to the actual use environment, but also the lowest luminance that can be actually displayed by the display device can be considered. Therefore, the determined gamma curve can more accurately present the luminance information of the display screen, the problem of poor performance of the display device in the related art is avoided, and the display effect of the display device is effectively improved.

Optionally, the display method is applicable to a display driving circuit.

Figure 10:
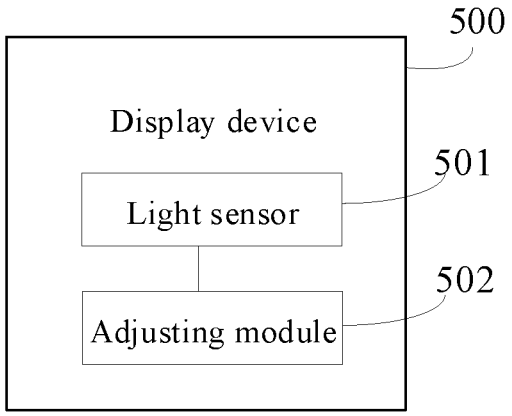
FIG. 10 is a block diagram of a display device according to an embodiment of the present disclosure.

FIG. 10 shows a block diagram of a display device 500 according to an embodiment of the present disclosure. The display device 500 includes a light sensor 501 and an adjusting module 502.

The light sensor 501 is configured to acquire luminance information of a current environment of the display device, and the adjusting module 502 is configured to determine a target gamma curve based on the luminance information.

In summary, in the display device according to the embodiment of the present disclosure, the gamma curve can be determined based on the luminance information of the current environment of the display device, such that a display effect of the display device can be flexibly adapted to changes of the environment of the display device, thereby avoiding the problem of poor effect of the display device in the related art and effectively enhancing the display effect of the display device.

In the field of display technology, the gamma curve may include the following two types according to the purpose. The first type is a screen-end gamma curve of the display screen. The screen-end gamma curve determines the luminance value of each sub-pixel in the display screen. The second type is a system gamma curve, which pre-processes each sub-pixel in an image to be displayed before the image to be displayed is displayed as a display screen. The system gamma curve may be set based on the screen-end gamma curve. In the process of presenting the scene on the display device as an image, firstly the system gamma curve may process the image to be displayed, and then the screen-end gamma curve may present the processed image to be displayed as a display screen.

The target gamma curve described in the display method according to the embodiment of the present disclosure may be the screen-end gamma curve or system gamma curve. The following describes the display device by taking the screen-end gamma curve (i.e., the first type gamma curve) or the system gamma curve (i.e., the second type gamma curve) as examples of the target gamma curve.

In the first case, when the determined target gamma curve is the screen-end gamma curve, the luminance value of each sub-pixel determined by the gamma curve may be directly output as the luminance value of the sub-pixel of the display screen, which ensures a display effect of the display screen.

Figure 11:
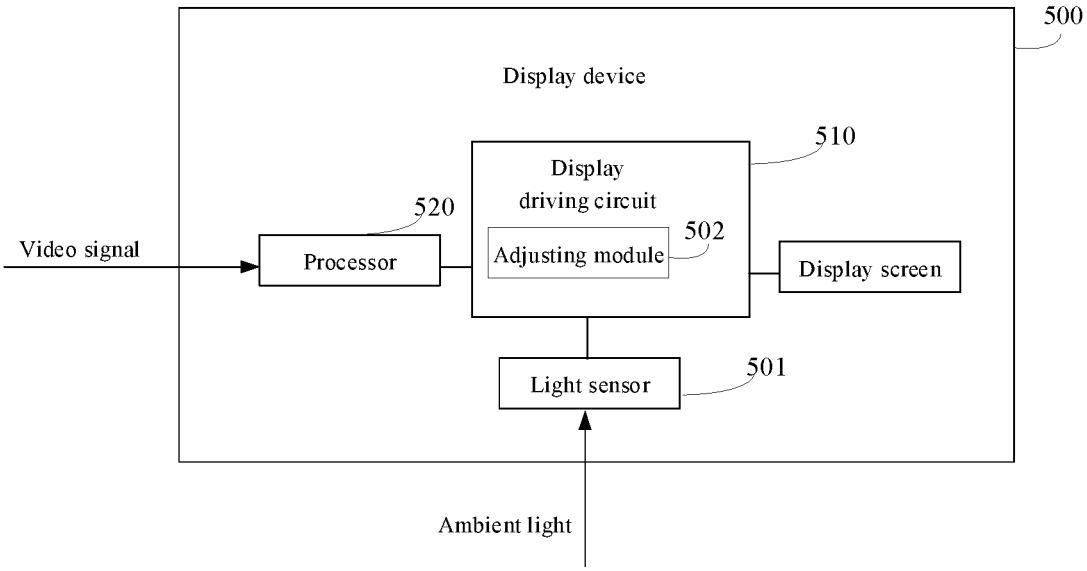
FIG. 11 is a block diagram of another display device according to an embodiment of the present disclosure.

In this case, as shown in FIG. 11, the display device 500 includes a display driving circuit 510, and the display driving circuit 510 includes an adjusting module 502. In an implementation of the embodiment of the present disclosure, the processor 520 may receive a video signal. The processor 520 may be a signal processor in a video signal processing system in the display device 500, and the processed video signal is sent to the display driving circuit 510. A gamma adjustment circuit is disposed in the display driving circuit 510, and the gamma adjustment circuit is provided with a programmable gamma curve and a register related to gamma parameters therein. The register may pre-store a corresponding relationship between multiple groups of different ambient luminance information and the corresponding gamma parameters therein. For example, the ambient luminance information includes the luminance value of ambient light, and the register may pre-store the corresponding relationship between multiple groups of different luminance value ranges of the ambient light and the corresponding gamma parameters therein, and for details about the stored corresponding relationship, reference may be made to step 203 in the display method. After the light sensor 501 sends the currently detected ambient luminance information to the display driving circuit 510, the display driving circuit 510 selects the corresponding gamma parameter from the register by querying the abovementioned corresponding relationship. The display driving circuit 510 adjusts the programmable gamma parameter based on the gamma parameter to acquire the target gamma curve. The display screen restores the image to be displayed based on the target gamma curve and an acquired grayscale value of the image to be displayed.

In a second case, when the determined target gamma curve is the system gamma curve, the image to be displayed processed by the system gamma curve will be further processed by the screen-end gamma curve. The screen-end gamma curve in this case is a predetermined gamma curve set in the display driving circuit.

Figure 12:
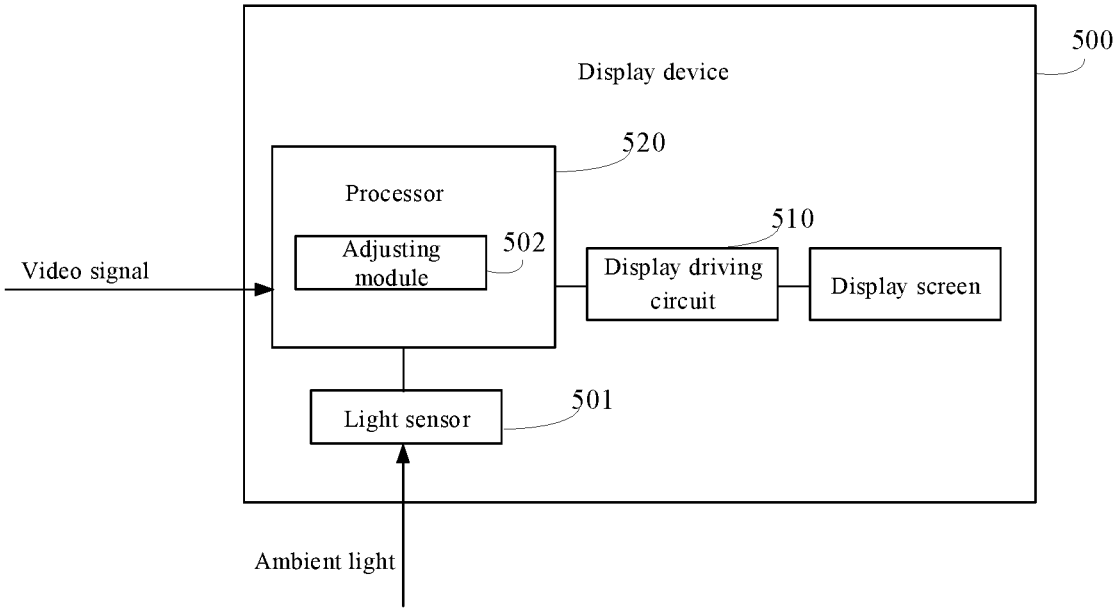
FIG. 12 is a block diagram of yet another display device according to an embodiment of the present disclosure.

In this case, as shown in FIG. 12, the display device 500 includes a processor 520, and the processor 520 includes an adjusting module 502. In an implementation of the embodiment of the present disclosure, the processor 520 may receive a video signal. The processor 520 may be a signal processor in the video signal processing system in the display device 500, and the processed video signal is sent to the display driving circuit 510. After the light sensor 501 sends the currently detected ambient luminance information to the processor 520, the processor 520 may determine the target gamma curve based on the luminance information. The processor 520 processes the image to be displayed based on the target gamma curve and then sends the image to be displayed to the display driving circuit 510. The processed image to be displayed is further processed by the display driving circuit 510 to acquire a display screen for the display screen to display.

Figure 13:
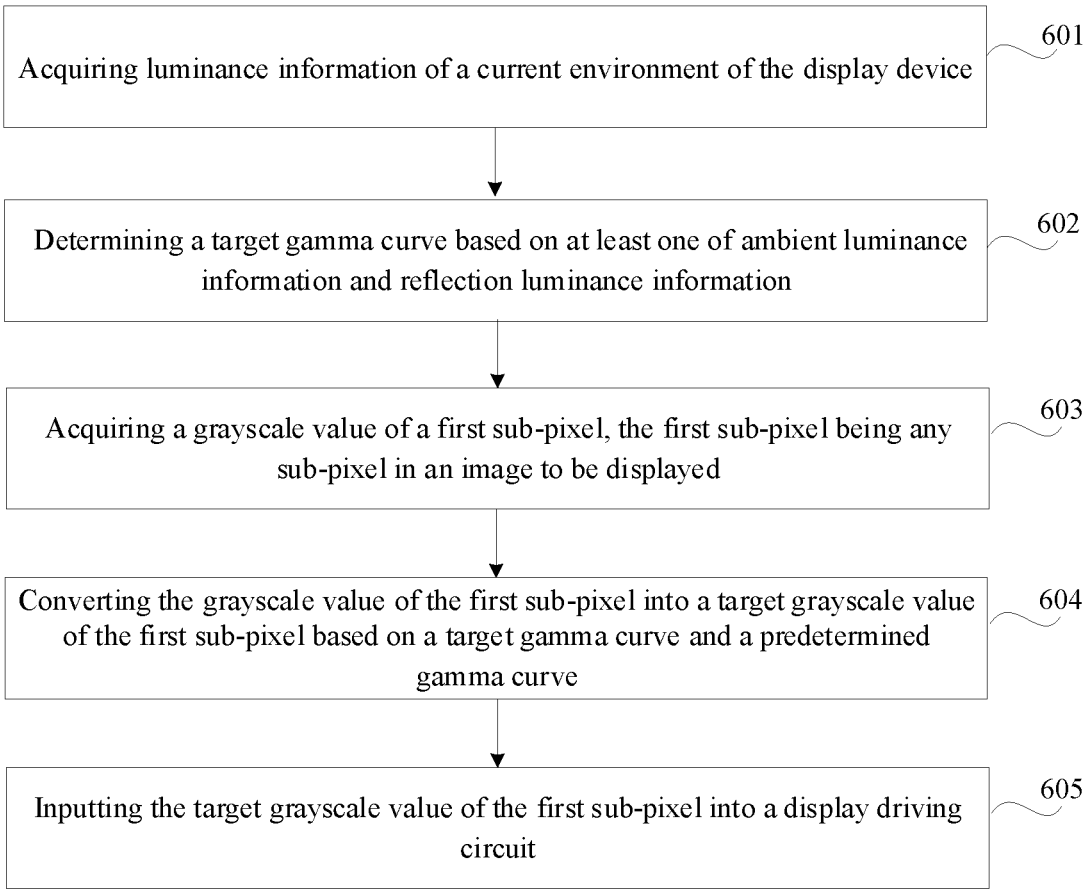
FIG. 13 is a flowchart of a further display method according to an embodiment of the present disclosure.

In an exemplary embodiment, FIG. 13 shows a display method applied to the display device shown in FIG. 12. The display device includes a processor and a display driving circuit. The method is applicable to the processor in the display device and a predetermined gamma curve is set in the display driving circuit. As shown in FIG. 13, the method may include the following steps.

In step 601, luminance information of a current environment of the display device is acquired.

The luminance information includes at least one of ambient luminance information and reflection luminance information. For details about step 60, reference may be made to the related description of step 201, which are not further described in the embodiment of the present disclosure.

In step 602, a target gamma curve is determined based on at least one of ambient luminance information and reflection luminance information.

For details about step 602, reference may be made to step 202 and step 203 in the above embodiment, step 302 and step 303 in the above embodiment, and step 402 to step 404 in the above embodiment.

In step 603, a grayscale value of a first sub-pixel is acquired, wherein the first sub-pixel is any sub-pixel in the image to be displayed.

In step 604, based on the target gamma curve and the predetermined gamma curve, the grayscale value of the first sub-pixel is converted into a target grayscale value of the first sub-pixel.

Since the gamma parameter in the target gamma curve (i.e., the system gamma curve) may be different from the gamma parameter in an inherent predetermined gamma curve (i.e., the screen-end gamma curve) of the display device, it may be difficult for the display driving circuit to accurately display a display screen consistent with the luminance of the image to be displayed. In order to accurately display the display screen corresponding to the image to be displayed based on an inherent display capability of the display screen, the grayscale value in the target gamma curve may be converted into a target grayscale value corresponding to the grayscale value in the predetermined gamma curve and capable of enabling the display screen to display the correct luminance before the predetermined gamma curve is adopted to further process the image to be displayed. It should be noted that in the present embodiment, the inherent predetermined gamma curve of the display device is inalterable. Therefore, the original grayscale value can be converted into the target grayscale value on a processor side to achieve the purpose of adjusting the gamma curve.

Both the target gamma curve and the predetermined gamma curve include luminance value, and then step 604 may include the following steps.

In step S1, a corresponding relationship between the grayscale value of the first sub-pixel and the target grayscale value of the first sub-pixel when a luminance value of the target gamma curve is equal to a luminance value of the predetermined gamma curve is acquired.

By taking the determination of the target gamma curve based on the ambient luminance information and the reflection luminance information as an example, referring to the second curve equation, the luminance value L of the target gamma curve is equal to $L_{max}[(n+n_0)/(N+n_0)]^{\gamma}$. The luminance value L' of the predetermined gamma curve may be expressed as: $L'=L_{max}[(m+n_0')/(N+n_0')]^{\gamma'}$, wherein L' is the target luminance value of the first sub-pixel, m is the target grayscale value of the first sub-pixel, $L_{max}$ is the maximum luminance reference value of the display device, γ' is the predetermined gamma parameter in the screen-end gamma curve, $n_0'$ is a grayscale correction parameter determined based on the predetermined gamma parameter γ', and for details about the determination process of $n_0$, reference may be made to the above embodiment.

Then, when the luminance value of the target gamma curve is equal to the luminance value of the predetermined gamma curve, that is, L=L', i.e., when $L_{max}[(n+n_0)/(N+n_0)]^{\gamma}=L_{max}[(m+n_0')/(N+n_0')]^{\gamma'}$, the corresponding relationship between the grayscale value n of the first sub-pixel and the target grayscale value m of the first sub-pixel can be determined: $m=(N+n_0')\ [(n+n_0)/(N+n_0)]^{\gamma/\gamma'}-n_0'$.

In step S2: the target grayscale value of the first sub-pixel is determined based on the corresponding relationship.

After the grayscale value n of the first sub-pixel is acquired, the target grayscale value m of the first sub-pixel may be determined based on the corresponding relationship.

It should be noted that the target grayscale value m determined by the above corresponding relationship may not be an integer. In this case, the target grayscale value may be rounded up or down to acquire an integer closest to the target grayscale value, and the integer is determined as the target grayscale value.

When the embodiment of the present disclosure is applied, the corresponding target grayscale value m may be calculated for all the grayscale values n from the $0^{th}$ level to the $N^{th}$ level based on the corresponding relationship, and the corresponding relationship between the grayscale value n and the target grayscale value m is stored in a grayscale conversion table, such that the processor can determine the grayscale value enabling the display driving circuit to display the correct luminance by querying the grayscale conversion table.

In step 605, the target grayscale value of the first sub-pixel is input into the display driving circuit.

The display driving circuit may drive a display panel for display based on the grayscale value.

It should be noted that when the above two types of gamma curves are introduced, it is mentioned that the system gamma curve may be set based on the screen-end gamma curve. The system gamma curve is actually a virtual gamma curve, and may be set according to a presenting situation of the screen-end gamma curve for the display screen.

In the display method and display device according to the embodiments of the present disclosure, when the target gamma curve is the screen-end gamma curve, since the screen-end gamma curve can accurately present the display screen, the system gamma curve does not need to process the image to be displayed earlier, and the system gamma curve may not be set in the processor. When the target gamma curve is the system gamma curve, the corresponding situation is that the screen-end gamma curve is an inherent predetermined gamma curve of the display device. It is difficult for the screen-end gamma curve to present an accurate display screen, so the target gamma curve can be configured to process the image to be displayed. At this point, the system gamma curve, that is, the target gamma curve may be set in the processor.

In summary, in the display device according to the embodiment of the present disclosure, the gamma curve can be adjusted based on the luminance information of the current environment of the display device, such that the display effect of the display device can be flexibly adapted to changes of the environment of the display device, thereby avoiding the problem of poor effect of the display device in the related art, and effectively improving the display effect of the display device. In addition, the gamma curve can also be determined based on the grayscale correction parameter and the gamma parameter, such that not only can the display effect of the display device be adapted to the actual use environment, but also the lowest luminance actually displayed by the display device can be considered. Therefore, the determined gamma curve can more accurately present the luminance information of the display screen, and the display effect of the display device is effectively improved.

The present disclosure also provides a display device, which includes a processor and a memory. The memory stores at least one instruction, at least one program, a code set, or an instruction set. The at least one instruction, the at least one program, the code set, or the instruction set, when loaded and executed by the processor, causes the processor to perform any display method according to the above embodiment.

The present disclosure also provides a computer storage medium storing at least one instruction, at least one program, a code set, or an instruction set. The at least one instruction, the at least one program, the code set, or the instruction set, when loaded and executed by a processor, causes the processor to perform any display method according to the above embodiment.

All the above optional technical solutions may be combined in any form to form optional embodiments of the present disclosure, which is not described herein any further.

It should be noted that the display device according to the above embodiment only takes division of respective functional modules as an example for explanation when executing the display method. In actual application, the above functions can be implemented by the different functional modules as required. That is, the internal structure of the device is divided into different functional modules to implemented all or part of the functions described above. In addition, the display device according to the above embodiment has the same concept as the display method methods. For details about the specific implementation process, reference may be made to the method embodiments, which are not described herein any further.

The display device described in the embodiments of the present disclosure may include a liquid crystal display (LCD) device, an organic light-emitting diode display (OLED) device, or the like.

Described above are merely exemplary embodiments of the present disclosure, and are not intended to limit the present disclosure. Within the spirit and principles of the disclosure, any modifications, equivalent substitutions, improvements, and the like are within the protection scope of the present disclosure.

What is claimed is:

1. A display method, comprising:

acquiring, by a light sensor, luminance information of a current environment of a display device, wherein the luminance information comprises at least one of ambient luminance information and reflection luminance information, and the ambient luminance information comprises a luminance value of ambient light in an environment of the display device; and determining, by a display driving circuit, a target gamma curve of the display device based on the acquired luminance information; and wherein when the luminance information comprises the ambient luminance information and the reflection luminance information, determining, by the display driving circuit, the target gamma curve of the display device based on the acquired luminance information comprises:

determining, by the display driving circuit, a gamma parameter based on the ambient luminance information;

determining, by the display driving circuit, a grayscale correction parameter based on the reflection luminance information and the gamma parameter; and determining, by the display driving circuit, the target gamma curve based on the grayscale correction parameter and the gamma parameter.

2. The method according to claim 1, wherein the reflection luminance information comprises a luminance value of reflected light of a display surface of the display device, and determining, by the display driving circuit, the grayscale correction parameter based on the reflection luminance information and the gamma parameter comprises:

determining, by the display driving circuit, a greater value of a minimum luminance value of light emergent from the display surface of the display device and the luminance value of the reflected light as a minimum luminance reference value of the display device; and determining, by the display driving circuit, the grayscale correction parameter based on the minimum luminance reference value of the display device and the gamma parameter.

3. The method according to claim 2, wherein determining the grayscale correction parameter based on the minimum luminance reference value of the display device and the gamma parameter comprises:

determining the grayscale correction parameter according to a first grayscale equation, wherein the first grayscale equation comprises:

$$L\min = L\max[n0/(N+n0)]\gamma;$$

wherein Lmin is the minimum luminance reference value of the display device, Lmax is a maximum luminance reference value of the display device, n0 is the grayscale correction parameter, γ is the gamma parameter, and N is a maximum grayscale value of the display device.

4. The method according to claim 1, wherein determining, by the display driving circuit, the target gamma curve based on the grayscale correction parameter and the gamma parameter comprises:

determining the target gamma curve according to a second curve equation, wherein the second curve equation comprises:

$$L = L\max[(n+n0)/(N+n0)]\gamma;$$

wherein L is a luminance value of a first sub-pixel, n is a grayscale value of the first sub-pixel, the first sub-pixel is one sub-pixel in the image to be displayed of the display device, Lmax is a maximum luminance reference value of the display device, γ is the gamma parameter, N is a maximum grayscale value of the display device, and n0 is the grayscale correction parameter.

5. The method according to claim 1, wherein the display device comprises a processor and the display driving circuit, the method is applicable to the processor, and a predetermined gamma curve is set in the display driving circuit, and after determining, by a display driving circuit, the target gamma curve of the display device based on the acquired luminance information, the method comprises:

acquiring a grayscale value of a first sub-pixel, wherein the first sub-pixel is one sub-pixel in an image to be displayed of the display device;

converting the grayscale value of the first sub-pixel into a target grayscale value of the first sub-pixel based on the target gamma curve and the predetermined gamma curve; and inputting the target grayscale value of the first sub-pixel to the display driving circuit.

6. The method according to claim 5, wherein parameters of the target gamma curve and parameters of the predetermined gamma curve both comprise luminance value, and converting the grayscale value of the first sub-pixel into a target grayscale value of the first sub-pixel based on the target gamma curve and the predetermined gamma curve comprises:

acquiring a corresponding relationship between the grayscale value of the first sub-pixel and the target grayscale value of the first sub-pixel when the luminance value of the target gamma curve is equal to the luminance value of the predetermined gamma curve; and determining the target grayscale value of the first sub-pixel based on the corresponding relationship.

7. A display device for performing the method according to claim 1, comprising:

a light sensor, configured to acquire luminance information of a current environment of the display device; and an adjusting module, configured to determine a target gamma curve based on the luminance information.

8. The display device according to claim 7, wherein the display device comprises a display driving circuit, the display driving circuit comprising the adjusting module; or the display device comprises a processor, the processor comprising the adjusting module.

9. A display device comprising a processor and a memory storing at least one instruction, at least one program, a code set, or an instruction set; wherein the at least one instruction, the at least one program, the code set, or the instruction set, when loaded and executed by the processor, causes the processor to:

acquire, by a light sensor, luminance information of a current environment of a display device, wherein the luminance information comprises at least one of ambient luminance information and reflection luminance information, and the ambient luminance information comprises a luminance value of ambient light in an environment of the display device; and determine, by a display driving circuit, a target gamma curve of the display device based on the acquired luminance information; and wherein when the luminance information comprises the ambient luminance information and the reflection luminance information, determining, by the display driving circuit, the target gamma curve of the display device based on the acquired luminance information comprises:

determining, by the display driving circuit, a gamma parameter based on the ambient luminance information;

determining, by the display driving circuit, a grayscale correction parameter based on the reflection luminance information and the gamma parameter; and determining, by the display driving circuit, the target gamma curve based on the grayscale correction parameter and the gamma parameter.

10. A non-transitory computer-readable storage medium storing at least one instruction, at least one program, a code set, or an instruction set; wherein the at least one instruction, the at least one program, the code set, or the instruction set, when loaded and executed by a processor, causes the processor to:

acquire, by a light sensor, luminance information of a current environment of a display device, wherein the luminance information comprises at least one of ambient luminance information and reflection luminance information and the ambient luminance information comprises a luminance value of ambient light in an environment of the display device; and determine, by a display driving circuit, a target gamma curve of the display device based on the acquired luminance information; and wherein when the luminance information comprises the ambient luminance information and the reflection luminance information, determining, by the display driving circuit, the target gamma curve of the display device based on the acquired luminance information comprises:

determining, by the display driving circuit, a gamma parameter based on the ambient luminance information;

determining, by the display driving circuit, a grayscale correction parameter based on the reflection luminance information and the gamma parameter; and determining, by the display driving circuit, the target gamma curve based on the grayscale correction parameter and the gamma parameter.

* * * * *